US010626682B2

(12) United States Patent
Hope et al.

(10) Patent No.: US 10,626,682 B2
(45) Date of Patent: Apr. 21, 2020

(54) CENTRALIZER DEVICE AND METHOD FOR DEPLOYMENT OF A BORE HOLE COMPONENT IN A BOREHOLE

(71) Applicant: Moonshine Solutions, A.S., Bergen (NO)

(72) Inventors: Helge Hope, Bergen (NO); Alf Breivik, Bergen (NO); Jan Georg Tveiterås, Bergen (NO)

(73) Assignee: Moonshine Solutions, A.S., Bergen (NO)

( * ) Notice: Subject to any disclaimer, the term of this patent is extended or adjusted under 35 U.S.C. 154(b) by 463 days.

(21) Appl. No.: 15/376,722

(22) Filed: Dec. 13, 2016

(65) Prior Publication Data

US 2017/0234082 A1 Aug. 17, 2017

Related U.S. Application Data

(63) Continuation of application No. PCT/NO2015/050119, filed on Jun. 26, 2015.

(30) Foreign Application Priority Data

Jul. 2, 2014 (NO) ..... 20140848

(51) Int. Cl.
*E21B 17/10* (2006.01)
*E21B 33/14* (2006.01)

(52) U.S. Cl.
CPC ..... *E21B 17/1028* (2013.01); *E21B 17/10* (2013.01); *E21B 17/1021* (2013.01); *E21B 17/1078* (2013.01); *E21B 33/14* (2013.01)

(58) Field of Classification Search
CPC .. E21B 17/10; E21B 17/1021; E21B 17/1028; E21B 17/1078
See application file for complete search history.

(56) References Cited

U.S. PATENT DOCUMENTS

| | | | | |
|---|---|---|---|---|
| 3,196,951 | A | 7/1965 | Saurenman | |
| 5,261,488 | A | 11/1993 | Gullet et al. | |
| 6,257,339 | B1 | 7/2001 | Haugen et al. | |
| 2009/0000793 | A1 * | 1/2009 | Guillot | E21B 17/1028 166/380 |

(Continued)

FOREIGN PATENT DOCUMENTS

EP 1793078 A1 6/2007

OTHER PUBLICATIONS

International Search Report and Written Opinion, International Application No. PCT/NO2015/050119.

(Continued)

*Primary Examiner* — Tara E Schimpf
(74) *Attorney, Agent, or Firm* — Richard A. Fagin

(57) ABSTRACT

A centralizer device for center positioning of a bore hole component (90, 91) in a bore hole and a method for deploying such a centralizer are described. The centralizer device (100) is prepared to have two possible different states, one state being a locked state for improved deployment and another state being a released state for centring. The transition from the locked state to the released state is performed by introducing a pill of bore fluid having a pH-value outside range of pH-values of bore fluid in a well. The pill of bore fluid dissolves pH-soluble material in the centralizer device.

8 Claims, 4 Drawing Sheets

(56) References Cited

U.S. PATENT DOCUMENTS

| | | | | |
|---|---|---|---|---|
| 2010/0078173 | A1 | 4/2010 | Buytaert et al. | |
| 2015/0034336 | A1* | 2/2015 | Morrison | E21B 17/1028 166/381 |
| 2015/0107830 | A1* | 4/2015 | Ersoz | E21B 43/263 166/259 |

OTHER PUBLICATIONS

Search Report, Norwegian Patent Application No. 20140848 dated Jan. 21, 2015.
Search Report, Australian Patent Application No. 2015284873 dated Jan. 25, 2019.

* cited by examiner

Fig 1
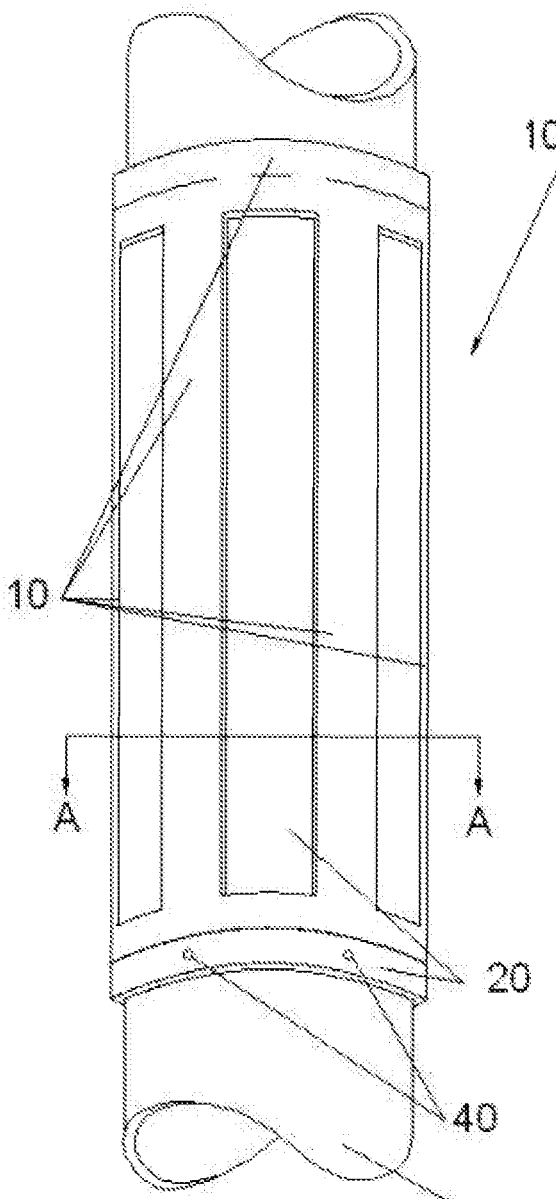
Fig 2
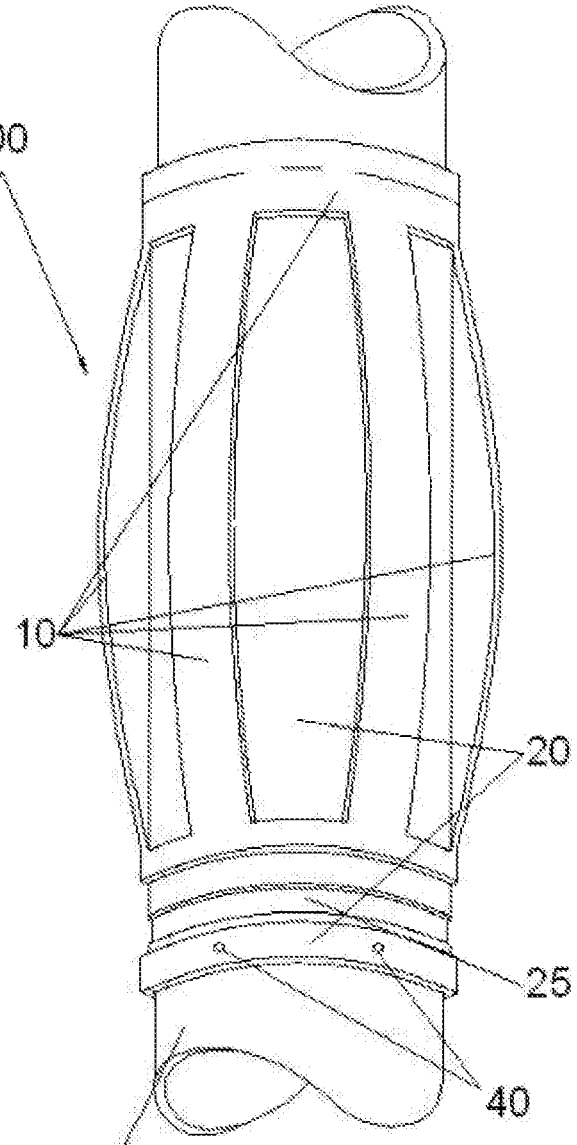
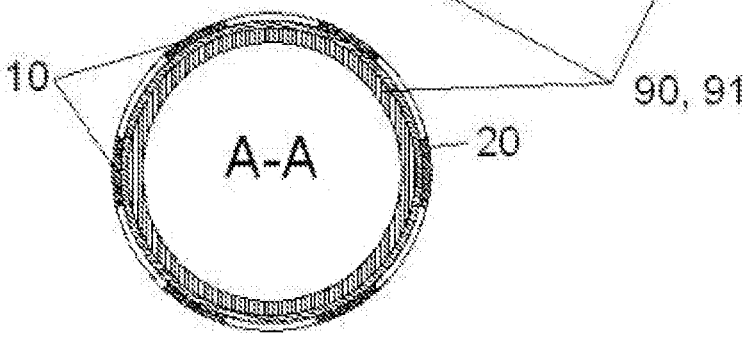
Fig 3

CENTRALIZER DEVICE AND METHOD FOR DEPLOYMENT OF A BORE HOLE COMPONENT IN A BOREHOLE

CROSS-REFERENCE TO RELATED APPLICATIONS

This is a continuation of International Application No. PCT/NO2015/050119 filed on Jun. 26, 2015. The foregoing application claims priority from Norwegian Patent Application No. 20140848 filed on Jul. 2, 2014. Both the foregoing applications are incorporated herein by reference in their entirely.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

The present disclosure is generally related to a centralizer device and a method for deploying a bore hole component in a borehole. More specifically, the disclosure relates to a centralizer device that is caused to be released when the centralizer device is deployed in a desired position in a borehole, wherein the centralizer device has a trigger that secures a center positioning of the bore hole component inside the borehole.

When a well for production of hydrocarbons such as oil and gas is to be constructed, a bore hole is in the first place drilled and is afterwards typically equipped with a casing in the form of a steel pipe. Cement is pumped into the pipe from the inside top of the steel pipe. When the cement reaches the bottom of the borehole, the cement is squeezed between the bore hole and the outside of the pipe. One important measure of the quality of the well construction is the degree to which the steel pipe is centred in the bore hole after the cement has hardened. This measure is often called standoff. A standoff of 100% specifies that the steel lining is positioned exactly in the center of the bore hole and that the cement is distributed with a uniform thickness in the annular space between the bore hole and the exterior of the pipe. If the steel pipe is positioned so as to touch the bore hole, the standoff is 0% at this position. Previously, the American Petroleum Institute, Washington, D.C., (API) specified a minimum standoff of 67%. Some oil and gas exploration and productions companies, such as Statoil ASA, require a standoff minimum of 70%. (Ref.: Statoil ASA Technical Requirements: TR3519 "2.3.2 Centralization".) In order to ensure controlled standoff, centralizer devices are used. Centralizer devices are devices such as, e.g., a simple bow-spring centralizer device that is described at the Uniform Resource Locator (URL) below:

http://www.glossary.oilfield.slb.cpm/em/Terms/c/centralizer.aspx.

Centralizer devices are positioned outside the pipe in a bore hole. Centralizer devices are positioned at an axial distance from each other that is so short, after hardening of the cement, that the pipe satisfies the requirements for standoff along the total length of the pipe. Bore holes that are curved or are horizontal will normally require that the axial distance between centralizers is shorter to compensate for increased load and tension in transverse direction to the longitudinal axis of the bore hole. The required axial distance between centralizer devices also depends on the respective diameters of the casing and bore hole. Centralizer devices are placed around a section of a casing when it is about to be lowered down in a bore hole. The centralizer device is often fastened directly to the casing and slides into the bore hole together with the section of the casing. Casings may keep standoff by centralizer springs in a centralizer device and more or less controlled strain between the outside of the casing and the wall of the bore hole. While the casing glides inwards, friction will naturally occur between said springs and the wall of the bore hole. A large friction may result in problems in deploying the casing. One may also experience that the centralizer device gets stuck or gets damaged so that the deployment is prevented or that the standoff becomes less than desired. This represents a trade-off between two contradicting requirements, on one side the centralizer device should be easy to deploy without incurring larger friction force than necessary, while on the other side should be standing as fixated as practically possible when the concrete flows downwards inside the casing and upwards on the outside of the casing and through all orifices of the centralizer devices. With unnecessary large friction forces, an increased risk of the centralizer device getting stuck and/or getting deformed or maybe destroyed may be experienced. This may result in the current requirements for standoff may get difficult to achieve.

When the casing is cast in cement, the cement inside the casing is normally drilled and what remains is a casing fixed by casting between the casing and the bore hole which is a good basis for further preparations for producing hydro carbon.

U.S. Patent Application Publication No. 2010/0078173 discloses a temperature controlled trigger device with which, e.g., a centralizer device may be deployed into a bore hole while it is fastened to a section of a casing. When the casing arrives at its longitudinal position, the centralizer device can be activated to spread out springs 12 that initially are placed along the casing and in this way do not spread out the springs 12 against the wall of the bore hole and create friction and other related problems. In said '173 publication, a so called memory alloy or SMA ["Shape Memory Alloy"] which is used for activation of a mechanism. SMA is a sort of metal alloy which is known to be deformable and to keep its deformed structure in a low temperature phase (in which the metal has a martensitic structure) and will thereafter resume its prior shape when it is brought into its high temperature phase/memory phase (in which the metal has an austenitic structure). The disclosed centralizer solves the problems with friction in the deployment phase in that the centralizer device in the first phase gets deformed to an appearance with a small outer diameter. When a casing having such a centralizer device is deployed down into a bore hole to where it is intended, the temperature thereafter has to be increased until it reaches the necessary temperature for the centralizer device mechanism to regain its high temperature phase resulting in the springs 12 of the centralizer device pressing against the wall of the bore hole. For this type of centralizer, the trigger temperature of the memory alloy must agree with the temperature relations in the particular bore hole. It is a problem that the trigger device is trigged at a temperature that is defined by the memory alloy and is difficult to adjust. The timing must also be sufficiently controllable in order to ensure that a practical method can be established to cause the trigger device to trigger when the casing is deployed at the correct place in the bore hole. The '173 publication also describes the possibility to lower the temperature in order for the memory alloy to keep its martensitic structure for a longer period in a deep bore hole. In this way such as centralizer may also be used for deep bore holes in which the temperature otherwise would cause triggering before the casing had reached the planned position. On the other hand, this would incur large costs.

U.S. Pat. No. 3,196,951 describes a centralizer with ribs formed as wires. These wires are separate parts that are to be installed on the centralizer before the entire assembly is slid onto a housing and the wires are fixed on the housing by stop collars 15, 16 and snap rings 17. When deploying the centralizer described in the '951 patent in a bore hole, the centralizer operates as an ordinary passive centralizer without means for reducing the mechanical resistance or improving the final centralization of the housing or other bore hole component.

SUMMARY

A centralizer device according to various aspects of the present disclosure provides a device and a method to ensure a robust and suitable deployment of a casing in a subsurface well. This regards not the least in horizontal wells, but also in vertical wells, sloping wells and parts of wells. Such centralizing may be obtained according to the present disclosure by means of a centralizer device that is arranged to possess the ability to be in at least two states in which the outer diameter of the centralizer, or the pressure against a wall in which it is deployed, are different. A locked state involves less friction than when using an ordinary centralizer device by involving less pressure between the centralizer device and the surrounding wall of a bore hole. It may even involve a smaller diameter of the centralizer device than the wall of the bore hole. The locked state is used for deploying the casing or other conduit longitudinally along the bore hole. The released state involves a larger pressure between the centralizer device and the surrounding wall of the bore hole than a traditional centralizer device, in order to ensure centralization of the casing or other conduit. Not the least it is important that the centralizer device, both during deployment and during running and cementing of the casing in the bore hole, is robust and reliable and suitable to fulfill predetermined requirements to centralization/standoff. Transition from the locked state to the released state may be performed according to the present disclosure by means of a trigger mechanism.

The disclosed centralizer device involves a centralizer for centralizing of a bore hole component in a bore hole, wherein the trigger mechanism is configured to have a locked state and a released state. The locked state is a state in which the trigger mechanism comprises an outer sleeve and an inner sleeve, the inner sleeve attached to the bore hole component. In the locked state of the centralizer device, the outer sleeve comprising ribs and an inner sleeve are locked to each other, so that longitudinal movements between the outer sleeve comprising ribs and the inner sleeve are prevented, in that there is deployed a lock spring inside an outer sleeve latch groove which also is in an inner sleeve latch groove. In the released state of the centralizer device, the outer sleeve comprising ribs and the inner sleeve are released from each other, so that movements between the outer sleeve and the inner sleeve are made possible because the lock spring is located in just one of the inner latch groove and the outer latch groove; and ribs in the outer sleeve are arranged to get released and attempt to increase its circumference, in that ribs are pre-tensioned outwards as with a larger diameter than the one in the locked state, so that the ribs push against the wall of the bore hole having a smaller diameter than said pre-tensioned ribs and in this way the centralizer is arranged to centre the bore hole component.

A centralizer device for centre positioning of a bore hole component in a bore hole according to the present disclosure is arranged to have two possible different states, one locked state and one released state. Said centralizer device comprises one outer sleeve comprising ribs and one inner sleeve being fastened to a bore hole component. A pre-tensioned lock spring is provided clinging to a pre-tensioned release spring with an opposite tension dominating the tension of the lock spring. In the locked state of the centralizer device the outer sleeve and the inner sleeve are locked to each other, so that longitudinal movement between the outer sleeve the inner sleeve is prevented, in that the lock spring is positioned both in an outer sleeve latch groove and in an inner sleeve latch groove; and the ribs are pre-tensioned with outward strain and the release spring being squeezed towards the inner sleeve by a snap ribbon. In the released state of the centralizer device the outer sleeve and the inner sleeve are released from each other so that longitudinal movement between the outer sleeve and the inner sleeve is made possible in that the lock spring is positioned completely in the outer sleeve latch groove. This results in the pre-tensioned ribs applying pressure against the wall of the bore hole; and the release spring being released and the lock spring as a consequence is positioned so that it is completely inside the outer sleeve latch groove. The snap ribbon has two possible different states related to the two states of the centralizer device, the locked and the released states. In the locked state of the snap ribbon it comprises one or more snap-ribbon units connected to each other. The snap-ribbon unit comprises a male snap-part, a female snap-part and pH-soluble material, positioned between the male snap-part and the female snap-part. pH-soluble material is material prepared to get dissolved when subject to fluid having a pH-value within a specified range. This arrangement locks the male snap-part and the female snap-part together on a first end of the male snap-part and a first end of female snap-part. The snap ribbon connected with an opposite end of a male snap-part joined to an opposite end of a female snap-part and deployed in the inner sleeve latch groove, has a length that results in squeezing said release spring towards the inner sleeve resulting in the lock spring locking the outer sleeve to the inner sleeve. In the released state of the snap ribbon, the pH-soluble material positioned between the male snap-part and the female snap-part has been dissolved and said interlocking is void and said squeezing of the release spring by the snap ribbon is void, resulting in the release spring being released. The lock spring being pressed inside the outer sleeve, the sleeves being released from each other enable the ribs pushing against the bore hole wall results in centralizing the centralizing device in the bore hole. The transition from the locked state to the released state is configured to be initiated by subjecting the pH-soluble material to a fluid having a pH value so as to dissolve the pH-soluble material.

In some embodiments, the fluid has a pH-value outside the range 9.0 to 9.5.

In some embodiments, the fluid has a pH-value outside the range 7.0 to 11.0.

In some embodiments, the borehole component is a casing.

In some embodiments, the borehole component is a foundation plug.

A method for deploying of a centralizer device according to the present disclosure may comprise the following actions. One side of a centralizer device is fastened longitudinally to a bore hole component to deploy the bore hole component together with the centralizer device in a bore hole. Bore fluid having a pH-value of between 7.0 and 11.0 is pumped into the bore hole component and further into the annulus between the bore hole component and the bore hole. A pill of bore fluid having a pH-value outside the range of pH-values of said bore fluid is pumped into the bore hole, initiating the centralizer device to change from its locked state to its released state so that the bore hole component gets centred inside the bore hole. The bore hole component may then be cemented in place.

In some embodiments, the borehole component comprises a casing.

In some embodiments, the borehole component comprises a foundation plug.

In some embodiments the bore fluid has a pH-value between 9.0 to 9.5.

BRIEF DESCRIPTION OF THE DRAWINGS

FIG. 1 is a longitudinal perspective view of a casing with a centralizer device around the casing, shown in its locked state.

FIG. 2 is a longitudinal perspective view of a casing with a centralizer device around the casing, shown in its released state.

FIG. 3 is a cross section view of a casing with a centralizer device around the casing, shown in its locked state.

Figure 4A:
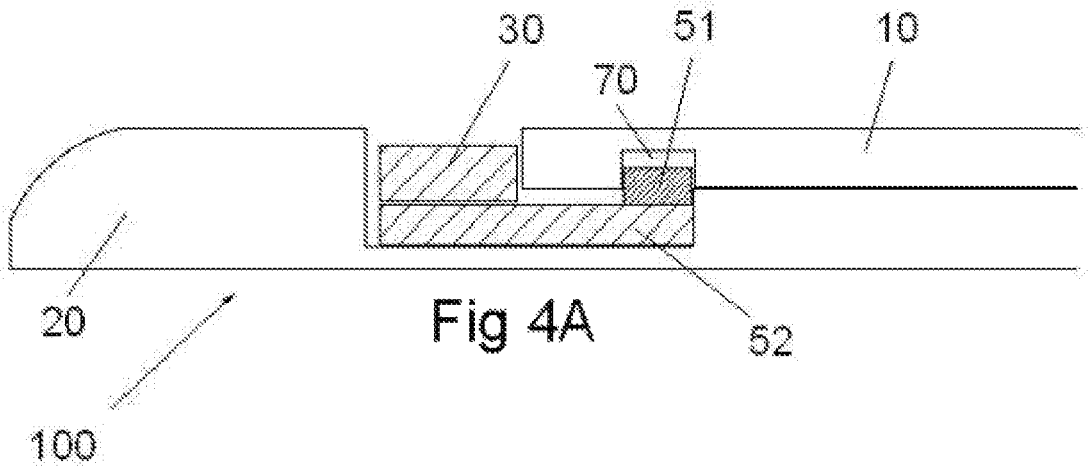
FIG. 4A is a longitudinal view through a part of one side of a centralizer in a locked state.

Reference numbers in the drawings relate to the following elements in the detailed description:

10 Outer sleeve
20 Inner sleeve
25 Inner sleeve latch groove
30 Snap ribbon
31 Male snap-part
32 Female snap-part
35 Snap ribbon unit
40 Set screw
51 Lock spring
52 Release spring
60 pH-soluble material
70 Outer sleeve latch groove
90 Bore hole component
91 Casing
100 Centralizer device

DETAILED DESCRIPTION

In the following a centralizer device and method are described in more detail with reference to the drawings.

One embodiment is shown in FIG. 1. When producing a well for exploration of hydrocarbon such as oil, a bore hole is bored into the formation in which it is assumed that there are deposits of hydrocarbon. Thereafter, segments of casing 91 are inserted after one another into the bore hole with so called centralizer devices 100 assembled on the outside of the casing segments. The centralizer devices 100 are assembled on the casing 91 with some distance between them, as mentioned previously. In deep bore holes and in particular at instances where the bore hole is curved and maybe continues sloping or in horizontal direction, frictions forces that operate against deploying forces when using conventional centralizer devices will make it all the more demanding to deploy the casing 91.

The centralizer device 100 is arranged around the casing 91 during deployment of the casing 91 in a bore hole and is to center the casing at suitable distances. In the present embodiment, the centralizer device 100 is configured to have two possible states. In the locked state, the casing 91, comprising one or more centralizer devices 100, all in their locked state but inside the bore hole, less force is pushing the ribs against the wall of the bore hole. Its diameter may even be smaller than the diameter of the borehole in the locked state of the centralizing device. The casing 91 will therefore experience less friction against the wall of the bore hole than with a conventional centralizer device which presses with greater force against a wall of a bore hole.

In FIG. 1, the centralizer device 100 is presented in its locked, not released, state called the "locked state." The centralizer device 100 has an inner sleeve 20 that is positioned proximate to the casing 91. The inner sleeve 20 is attached to the casing 91 so that the inner sleeve 20 is arranged to prevent movement of the inner sleeve 20 along the casing 91. This attachment can be accomplished by e.g. utilizing one or more set screws 40 through the inner sleeve 20 and towards the casing 91. An outer sleeve 10 with ribs is positioned immediately on the outside of the inner sleeve 20. The ribs on this are in the locked state pre-tensioned so that the outer sleeve 10 with ribs, when not inserted into a well, has a smaller diameter as compared with in the released state. One longitudinal end of the outer sleeve extends longer than the inner sleeve 20 and constitutes an edge in that the outer sleeve 10 with ribs has an inner diameter that is less than the outer diameter of the inner sleeve 20 in this end. The outer sleeve 10 rests with this edge against the end of the inner sleeve 20 and the outer sleeve 10 is in the locked state pre-tensioned in that its second end in the longitudinal direction is stretched so that an inner sleeve latch groove 25 is positioned opposite an outer sleeve latch groove 70. The outer sleeve 10 is locked in this locked state because there is one lock spring 51 positioned in both the inner sleeve latch groove 25 and in the outer sleeve latch groove 70.

In FIG. 1, the centralizer device 100 is shown in the locked state. The ribs of the outer sleeve 10 are pre-tensioned with outward strain. The outer sleeve 10 is fixed to the borehole component 90, 91 e.g. with a set screw 40 or otherwise. The outer sleeve 10 is fastened proximate one longitudinal end to the inner sleeve 20. In order to stay in this locked state, a locking mechanism is arranged.

FIG. 2 is a longitudinal perspective view of a casing 91 with a centralizer device 100 around the casing, shown in its released state.

FIG. 3 is a cross section view of a casing with a centralizer device around the casing, shown in its locked state.

In FIG. 4A, a lock spring 51 is positioned both in the outer sleeve latch groove 70 and in an inner sleeve latch groove (25 in FIG. 4C) in an opposite longitudinal end of the inner sleeve 20. With this locking mechanism, the outer sleeve 10 is prevented from releasing the pre-tension of its ribs, thereby the centralizer device 100 and the lock spring 51 stay in this locked state.

The present locking mechanism, using a lock ring to prevent and enable longitudinal movement between two sleeves may be used together with not only the present embodiment of a centralizer device 100, but to other ways of triggering, e.g. rubber swelling when exposed to pH-variations, electrical triggering, triggering by elevated temperature in the well bore over some length of time. The locking mechanism can also be used with arrangements with modified details of the present disclosure.

Said lock spring 51 is pre-tensioned so that it clings to a release spring 52. Said release spring 52 is pre-tensioned the opposite way so that the lock spring 51 clings to the release spring 52.

Figure 4B:
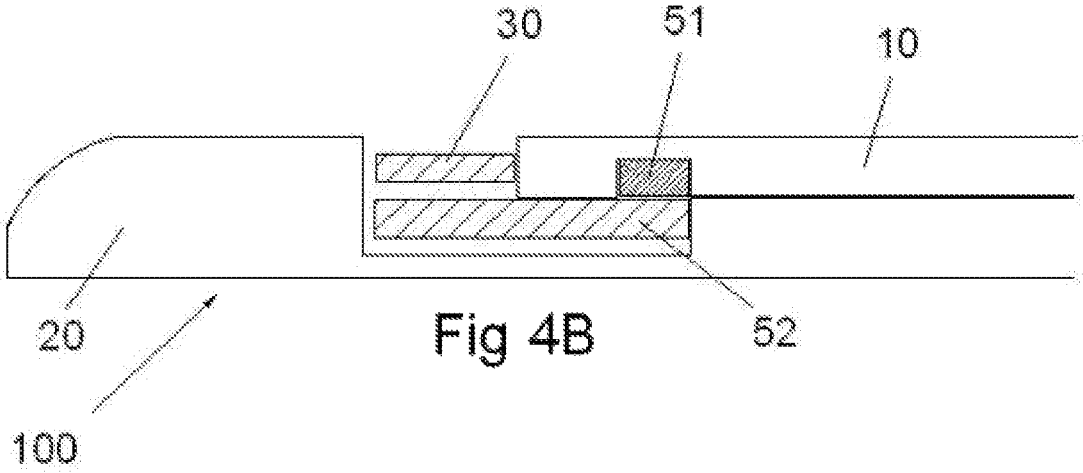
FIG. 4B is a longitudinal view through a part of one side of a centralizer about to change states from locked to released.

In FIG. 4B, the release spring 52 is shown in transition between the locked state and a released state of the centralizer device 100 and the lock spring 51. The lock spring 51, still clinging to the release spring 52, is moved generally in its entirety into the outer sleeve latch groove 70. The pre-tension of the ribs of the outer sleeve 10 results in a longitudinal force tending to move the outer sleeve 10 along the inner sleeve 20. With the lock spring 51 now inside the outer sleeve latch groove 70, the outer sleeve 10 will move as indicated. The lock spring 51 will then slide on the outside of the inner sleeve 20.

The release spring 52 is kept in a locked state by a snap ribbon 30, also in a locked state, positioned outside and around said release spring 52. The snap ribbon 30 squeezes the release spring 52 toward the inner sleeve 20.

Figure 4C:
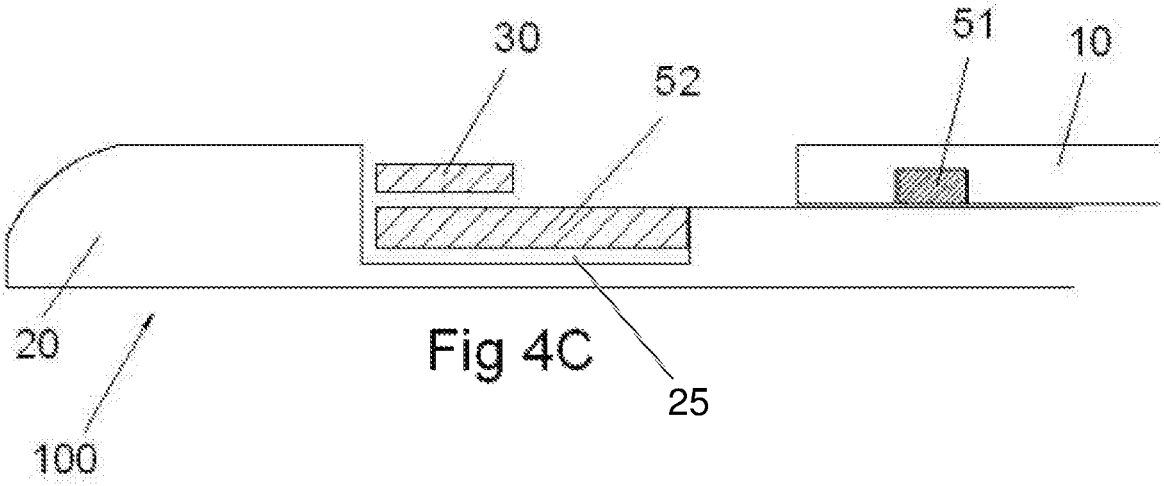
FIG. 4C is a longitudinal view through a part of one side of a centralizer in a released state.

FIG. 4C shows the locking mechanism in the released position, wherein the release spring 52 is no longer restrained by the lock spring 51.

Figure 5A:
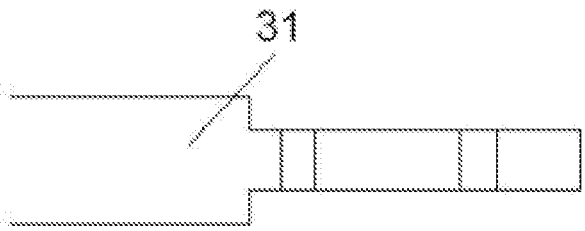
FIG. 5A is a top view of a male snap-part.
Figure 5B:
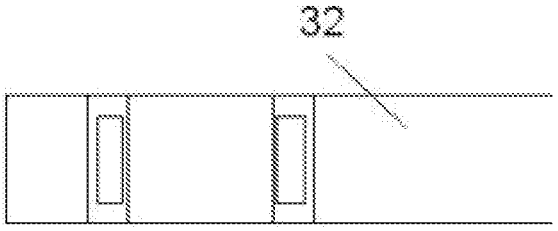
FIG. 5B is a top view of a female snap-part.
Figure 5C:
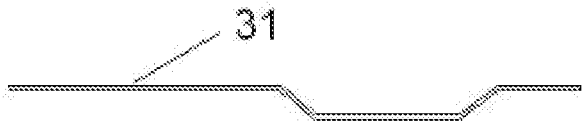
FIG. 5C is a side view of the male snap-part.
Figure 5D:
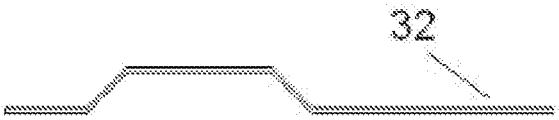
FIG. 5D is a side view of a female snap-part.
Figure 5E:
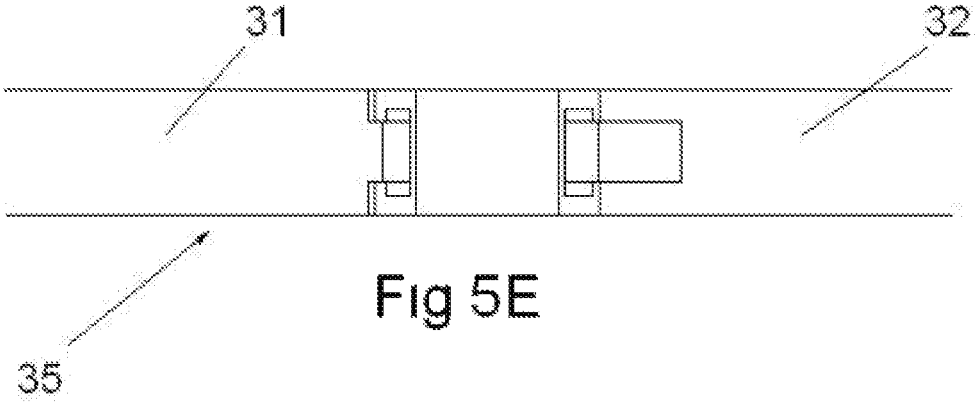
FIG. 5E is a top view of a snap-ribbon unit.
Figure 5F:
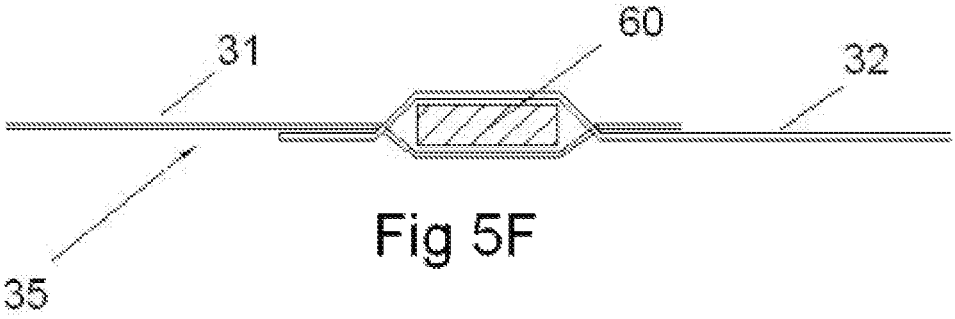
FIG. 5F is a side view of the snap-ribbon unit.
Figure 5G:
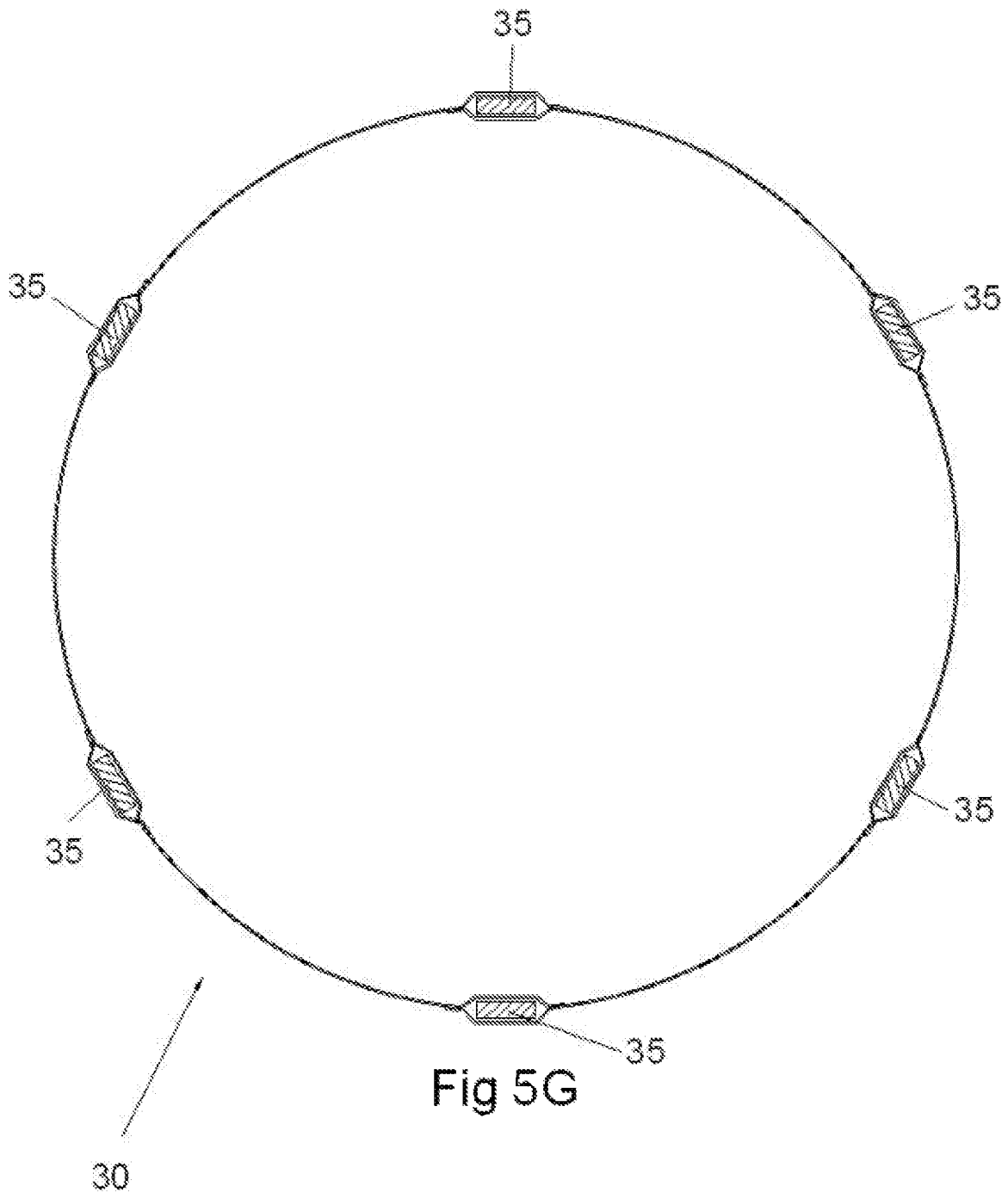
FIG. 5G is a side view of a snap-ribbon with six snap-ribbon units.

The snap ribbon 30 comprises at least one snap ribbon unit (35 in FIG. 5G) connected back to back to itself or one snap ribbon unit (35 in FIG. 5G) to another one as indicated in FIG. 5G. In FIG. 5G there are 6 snap ribbon units 35, but the minimum snap ribbon units 35 in a snap ribbon is 1.

Referring to FIG. 5F, the snap ribbon unit 35 comprises a male snap-part 31, a female snap-part 32 and pH-soluble material 60.

A male snap-part 31 is presented in FIG. 5A seen from above and in FIG. 5C seen in side view. A female snap-part 32 is presented in FIG. 5B seen from above and FIG.

5D seen in side view. FIG. 5E indicates in top view how a male snap-part 31 and a female snap-part 32 can be assembled. FIG. 5F indicates this in side view and in this figure, a piece of pH-soluble material 60 is also inserted which locks the male snap-part 31 and the female snap-part 32 together. The snap ribbon unit 35 then is in a locked state.

FIG. 5G presents the snap ribbon 30 with six snap ribbon units 35 all in locked state resulting in the snap ribbon itself being in a locked state.

With all components of the centralizer device 100 assembled and in the locked state, the centralizer device 100 may be entered around a borehole component 90, 91 as described above. Then the centralizer device 100 and the borehole component 90, 91 may be inserted into the borehole. They are, as persons in the art will understand, inserted one after another. The distance between the centralizer devices may vary depending on conditions e.g. angle of deployment of the bore hole component 90, 91. One deployed borehole component 90, 91 may carry none, one or more than one centralizer device 100.

When the bore hole components 90, 91 including centralizer devices 100 are deployed in the borehole, a pill with a pH-value that makes pH-soluble material 60 in the snap ribbon units 35 of the snap ribbons 30 of the centralizer devices 100 dissolve is inserted in a flow of drill fluid. This results in the pH-soluble material 60 dissolving and then a snap ribbon unit 35, the snap ribbon 30, the release spring 52, the lock spring 51 and the outer sleeve 10 comprising ribs, leaving their locked state and entering the released state. In other words, it makes the centralizer devices 100 leave the locked state and enter the released state. In the released state the centralizer devices 100 push their ribs against the wall of the bore hole and centralizes the bore hole component 90, 91. Afterwards, cement may be pumped inside the bore hole component 90, 91 and further to the annulus between the bore hole component 90, 91 and the wall of the bore hole.

All the time before cement fixes the bore hole component 90, 91, the bore hole component 90, 91 may freely be rotated, both when the centralizer 100 is in its locked state and when in its released state.

A centralizer device 100 in the locked state and deployed in a bore hole with a drill fluid as described in the above paragraph will stay in its locked state.

A so called drill fluid pill may be added to drill fluid in order to modify properties of the drill fluid. A drill fluid pill arranged to modify the pH-value in the used drill fluid by e.g. plus 2, e.g. from a pH-value in the range of 9.0 to 9.5 to a pH-value of between 11.0 and 11.5. Further on, the centralizer device 100 is arranged so that it in an environment of drill fluid of at least 11.0 moves from the locked state to the released state. The locked state will get the permanent one that the centralizer device stays in, even if the pH-value drops to less than 11.0 again after that the centralizer device 100 has entered the released state.

In another embodiment, a drill fluid pill arranged to modify the pH-value in the drill fluid in question by minus 2 may be added to the drill fluid, e.g. from a pH-value in the range of 9.0 to 9.5 to a pH-value of between 7.0 and 7.5. The centralizer device 100 is further on arranged so that in an environment of drill fluid having a pH-value of less than 7.5 the device 100 transforms from its locked state to its released state. The centralizer device 100 will remain in the released state, even if the pH-value subsequently increases to more than 7.5 after that the centralizer device 100 has entered the released state.

In another embodiment, a drill fluid pill arranged to modify the pH-value in the drill fluid in question by plus 3 may be added to the drill fluid, e.g. from a pH-value in the range of 7.0 to 10.0 to a pH-value of between 10.0 and 13.0. The centralizer device 100 is further on arranged so that it in an environment of drill fluid having a pH-value of at least 13.0 transforms from its locked state to its released state. The centralizer deice 100 will stay permanently in the released state, even if the pH-value subsequently changes to less than 10.0 again after that the centralizer device 100 has arrived at its released state.

In another embodiment, a drill fluid pill arranged to modify the pH-value in the drill fluid in question by minus 3 may be added to the drill fluid, e.g. from a pH-value in the range of 7.0 to 10.0 to a pH-value of between 4.0 and 7.0. The centralizer device 100 is further on arranged so that it in an environment of drill fluid having a pH-value of less than 7.0 transforms from its locked state to its released state. The centralizer device 100 will stay permanently in the released state, even if the pH-value subsequently increases to more than 7.0 after that the centralizer device 100 has arrived at its released state.

In other embodiments, a method and centralizer device according to the present disclosure may be used to center a mechanical plug (not shown in the drawings) that is to operate as a foundation for establishing a concrete plug (not shown in the drawings), a so called foundation plug. Such a foundation plug with a cement plug on top can be used for different operation purposes:

1. Drilling of side step. In this embodiment, the foundation plug and the cement plug constitute a ramp resulting in drilling that follows is guided away from the present well track and in a preferred angle from this.
2. Sealing of a problem zone. In this embodiment, the foundation plug and the cement plug are used to seal off a problem zone e.g. comprising gas that one have drilled into.
3. Preventing cross flow of hydro carbons. In this embodiment, the foundation plug and the cement plug are used to prevent cross flow of hydro carbons in a reservoir.

Drill fluid may be oil based or water based. The methods and apparatus according to the present disclosure can be used with both types. One example of the former is Versatec OBM (Oil Based Mud) that may have a pH-value of between 9.0 and 9.5. An example of the second type, WBM (Water Based Mud) is Glydril that may have a pH-value of between 7.0 and 9.0.

Those versed in the art will recognize that the pH-limit values of both drill fluid, pH-soluble material (60 in FIG. 5F) and drill fluid pills may vary within wide boundaries. In order for a centralizing device according to the present disclosure to operate according to its purpose, these values may be chosen based upon practical reasoning so as to ensure that the centralizer device 100 is not released from its locked state with the chosen drill fluid, but is arranged to be released and arrive in its released state when the pH-soluble material contacts the chosen drill fluid pill.

In the present disclosure, the terms drill fluid and mud are intended to mean the same thing. pH-soluble material (60) that has dissolved is in the present document regarded as equivalent to being void.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f), for any limitations of any of the claims herein, except for those in which the claim expressly uses the words "means for" together with an associated function.

What is claimed is:

1. A centralizer device (100) for center positioning of a bore hole component (90, 91) in a bore hole, said centralizer device (100) having two possible different states, one locked state and one released state;

said centralizer device (100) comprising one outer sleeve (10) comprising ribs and one inner sleeve (20), said inner sleeve (20) being fastened to a bore hole component (90, 91);

said centralizer device (100) comprising:

a lock spring (51) being pre-tensioned so that it clings to a release spring (52), said release spring (52) being pre-tensioned with an opposite tension exceeding the tension of the lock spring (51); wherein, in the locked state of the centralizer device (100), the outer sleeve (10) and the inner sleeve (20) are locked to each other, so that longitudinal movement between the outer sleeve (10) and the inner sleeve (20) is prevented, wherein the lock spring (51) is positioned both in an outer sleeve latch groove (70) and in an inner sleeve latch groove (25), the ribs are pre-tensioned with outward strain; said release spring (52) being squeezed toward the inner sleeve (20) by a snap ribbon (30), wherein in the released state of the centralizer device (100):

the outer sleeve (10) and the inner sleeve (20) are released from each other, so that longitudinal movement between the outer sleeve (10) and the inner sleeve (20) is enabled wherein the lock spring (51) is positioned completely in the outer sleeve latch groove (70) resulting in said pre-tensioned ribs applying pressure against a wall of the bore hole, said release spring (52) is released and the lock spring (51) as a consequence is positioned so that it is completely inside the outer sleeve latch groove (70), said snap ribbon (30) having a locked and a released states, each such snap ribbon state corresponding to a state of the centralizer device, wherein in the locked state said snap ribbon (30) comprises one or more snap-ribbon units (35) connected to each other, said one or more snap-ribbon units each (35) comprising:

a male snap-part (31);

a female snap-part (32); and pH-soluble material (60) positioned between the male snap-part (31) and the female snap-part (32) locking the male snap-part (31) and the female snap-part (32) together on a first end of the male snap-part (31) and a first end of female snap-part (32), said pH-soluble material (60) being soluble in an environment having a specified pH-value, said snap ribbon (30), connected with an opposite end of a male snap-part (31) joined to an opposite end of a female snap-part (32) and deployed in the inner sleeve latch groove (3) having a length squeezing said release spring towards the inner sleeve (20) resulting in the lock spring (51) locking the outer sleeve (10) to the inner sleeve (20);

wherein in the released state of the snap ribbon (30), said pH-soluble material (60) positioned between the male snap-part (31) and the female snap-part (32) is dissolved and locking of the snap ribbon units to each other is stopped, and said squeezing of the release spring by the snap ribbon is stopped, resulting in the release spring (52) being released and the lock spring (51) being pressed inside the outer sleeve (10), the sleeves (10, 20) being released from each other enabling the ribs pushing against the bore hole wall and centralizing the centralizing device (100) in the bore-hole, and wherein, the transition from the locked state to the released state being initiated by subjecting the pH-soluble material (60) to a pH value selected to cause dissolving the pH-soluble material (60).

2. The centralizer device (100) according to claim 1, wherein said pH-soluble material (60) is soluble in an environment with a pH-value outside the range 9.0 to 9.5.

3. The centralizer device (100) according to one of claim 1 wherein said pH-soluble material (60) soluble in an environment with a pH-value outside the range 7.0 to 11.0.

4. The centralizer device (100) according to one of claim 1, wherein the bore hole component (90) comprises a casing (91).

5. A method for deploying of a centralizer device (100), characterized by:

fastening one side of a centralizer device (100) to a bore hole component (90, 91);

deploying the bore hole component (90, 91) together with the centralizer device (100) in a bore hole;

pumping bore fluid having a first pH-value into the bore hole component (90, 91) and further into an annulus between the bore hole component (90, 91) and the bore hole;

pumping a pill of bore fluid, having a pH-value to modify the first pH value to a second pH value, wherein the second pH value is such that a pH soluble material lock dissolves, thereby initiating moving the centralizer device (100) from a locked state to a released state so that the bore hole component (90, 91) is centered inside the bore hole; and cementing the bore hole component (90, 91);

wherein the centralizer device (100) comprises:

one outer sleeve (10) comprising ribs and one inner sleeve (20), said inner sleeve (20) being fastened to the bore hole component (90, 91);

a lock spring (51) being pre-tensioned so that it clings to a release spring (52), said release spring (52) being pre-tensioned with an opposite tension exceeding the tension of the lock spring (51); and wherein, in the locked state of the centralizer device (100), the outer sleeve (10) and the inner sleeve (20) are locked to each other, so that longitudinal movement between the outer sleeve (10) and the inner sleeve (20) is prevented, wherein the lock spring (51) is positioned both in an outer sleeve latch groove (70) and in an inner sleeve latch groove (25), the ribs are pre-tensioned with outward strain; said release spring (52) being squeezed toward the inner sleeve (20) by a snap ribbon (30), wherein in the released state the outer sleeve (10) and the inner sleeve (20) are released from each other, so that longitudinal movement between the outer sleeve (10) and the inner sleeve (20) is enabled wherein the lock spring (51) is positioned completely in the outer sleeve latch groove (70) resulting in said pre-tensioned ribs applying pressure against a wall of the bore hole, said release spring (52) is released and the lock spring (51) as a consequence is positioned so that it is completely inside the outer sleeve latch groove (70) said snap ribbon (30) having a locked and a released states, each such snap ribbon state corresponding to a state of the centralizer device, wherein in the locked state said snap ribbon (30) comprises one or more snap-ribbon units (35) connected to each other, said one or more snap-ribbon units (35) each comprising a male snap-part (31), a female snap-part (32) and the pH-soluble material (60) positioned between the male snap-part (31) and the female snap-part (32) locking the male snap-part (31) and the female snap-part (32) together on a first end of the male snap-part (31) and a first end of female snap-part (32), said pH-soluble material (60) being soluble in an environment having a specified pH-value, said snap ribbon (30), connected with an opposite end of a male snap-part (31) joined to an opposite end of a female snap-part (32) and deployed in the inner sleeve latch groove (3) having a length squeezing said release spring towards the inner sleeve (20) resulting in the lock spring (51) locking the outer sleeve (10) to the inner sleeve (20), wherein in the released state of the snap ribbon (30), said pH-soluble material (60) positioned between the male snap-part (31) and the female snap-part (32) is dissolved and locking of the snap ribbon units to each other is stopped, and said squeezing of the release spring by the snap ribbon is stopped, resulting in the release spring (52) being released and the lock spring (51) being pressed inside the outer sleeve (10), the sleeves (10, 20) being released from each other enabling the ribs pushing against the bore hole wall and centralizing the centralizing device (100) in the bore-hole, and wherein, the transition from the locked state to the released state being initiated by subjecting the pH-soluble material (60) to a pH value selected to cause dissolving the pH-soluble material (60).

6. The method according to claim 5, wherein the bore hole component (90) comprises a casing (91).

7. The method according to claim 5, wherein the first pH-value is between 9.0 to 9.5, and the second pH value is between 7.0 and 7.5.

8. The method according to claim 5 wherein the second pH value is between 11.0 and 11.5.

* * * * *